United States Patent [19]

Mukae et al.

[11] Patent Number: 4,477,793

[45] Date of Patent: Oct. 16, 1984

[54] ZINC OXIDE NON-LINEAR RESISTOR

[75] Inventors: Kazuo Mukae; Satoshi Maruyama; Koichi Tsuda; Ikuo Nagasawa, all of Kanagawa, Japan

[73] Assignees: Fuji Electric Co., Ltd.; Fuji Electric Corporate Research and Development, Ltd., both of Kanagawa, Japan

[21] Appl. No.: 509,080

[22] Filed: Jun. 29, 1983

[30] Foreign Application Priority Data

Jun. 30, 1982 [JP] Japan ..... 57-113292
Jun. 30, 1982 [JP] Japan ..... 57-113293
Jun. 30, 1982 [JP] Japan ..... 57-113294

[51] Int. Cl.[3] ..... H01C 7/10; H01B 1/08

[52] U.S. Cl. ..... 338/21; 252/521; 252/518

[58] Field of Search ..... 338/21, 20; 252/518, 252/520, 521

[56] References Cited

U.S. PATENT DOCUMENTS 4,033,906 7/1977 Nagasawa et al. ..... 338/20 X
4,038,217 7/1977 Namba et al. ..... 338/20 X
4,069,061 1/1978 Nagasawa et al. ..... 338/20 X
4,077,915 3/1978 Yodogawa ..... 338/21 X
4,160,748 7/1979 Yodogawa ..... 252/521 X
4,169,071 9/1979 Eda et al. ..... 252/518 X
4,285,839 8/1981 Wong ..... 252/521 X
4,326,187 4/1982 Miyoshi et al. ..... 252/518
4,383,237 5/1983 Eda et al. ..... 338/21
4,386,022 5/1983 Nayasawa et al. ..... 338/20 X
4,397,775 8/1983 Levinson ..... 252/518

*Primary Examiner*—C. L. Albritton
*Assistant Examiner*—Christopher N. Sears
*Attorney, Agent, or Firm*—Sughrue, Mion, Zinn, Macpeak & Seas

[57] ABSTRACT

A voltage non-linear resistor in the form of a sintered body is disclosed. The sintered body is comprised of 0.08 to 5.0 atomic % of a rare earth element, 0.1. to 10 atomic % of cobalt, $5\times10^{-4}$ to $1\times10^{-1}$ atomic % of boron and an additional component which may be 0.01 to 5.0 atomic % of magnesium or calcium and/or $1\times10^{-4}$ to $5\times10^{-2}$ atomic % of aluminum, gallium or indium. The remainder of the sintered body is comprised of zinc oxide. The sintered body provides a small voltage non-linear resistor with high discharge current withstand capability and good life performance.

2 Claims, No Drawings

ZINC OXIDE NON-LINEAR RESISTOR

FIELD OF THE INVENTION

This invention relates to a voltage non-linear resistor and, more particularly, to a voltage non-linear resistor composed mainly of zinc oxide (ZnO), which is used as an overvoltage protective element.

BACKGROUND OF THE INVENTION

For protecting electronic devices and electrical equipments from overvoltage, varistors composed mainly of silicon carbide (SiC), selenium (Se), silicon (Si), or zinc oxide (ZnO) have been employed. Since the varistors composed mainly of ZnO, which are described, for example, in U.S. Pat. No. 3,663,458, are generally provided with characteristics such as low limiting voltage, large voltage non-linear exponent, and the like, they are fitted to the overvoltage protection for the electronic device constituted by semiconductor elements having a low overcurrent withstand capacity. Therefore, ZnO varistors have been employed instead of SiC varistors.

In addition, it has been known from the description of, for example, U.S. Pat. No. 4,033,906, that a voltage non-linear resistor, produced by adding additives of a rare earth element and cobalt (Co) to a main component of ZnO in the form of an element or compound, and sintering the composition, or a voltage non-linear resistor, produced by adding magnesium (Mg) or calcium (Ca) to these additives in the form of an element or compound, and sintering the composition, has good voltage non-linearity. However, such voltage non-linear resistors have disadvantages. For example, their discharge current withstand capability is slightly low and their life performance is low. Therefore, there is provided a problem for obtaining a small resistor.

The inventors have investigated the destruction mechanism of the resistor due to the surge in order to determine a method to prevent destruction.

SUMMARY OF THE INVENTION

Therefore, it is an object of the present invention to provide a small voltage non-linear resistor with high discharge current withstand capability and good life performance.

The inventors have found that when a high surge current is applied to a conventional voltage non-linear resistor composed of a sintered body of a main component of ZnO containing additives of a rare earth element and cobalt, or a conventional voltage non-linear resistor composed of a sintered body of a main component of ZnO containing additives of magnesium or calcium in addition to the additives, a current concentration due to the concentration of electric field is generated at the circumference of an electrode formed on both surfaces of the resistor, resulting in the destruction of the resistor by the current concentration.

Further, the inventors have confirmed that inhomogeneous portions are locally provided in the internal portion of the resistor, and have found that the applied current is concentrated to the inhomogeneous portions when DC current is supplied thereto, thereby causing the characteristics deterioration.

As a result of carrying out investigations for eliminating these problems, the inventors have found that the resistance of the circumference of a resistor can be made slightly higher than the internal portion thereof by including additives of boron and at least one kind of aluminum, gallium and indium to the conventional voltage non-linear resistor composed of the main component of ZnO and the additives of a rare earth element and cobalt, or by further including additives of boron, or boron and at least one kind of aluminum, gallium and indium to the conventional voltage non-linear resistor composed of the main component of ZnO and the additives of a rare earth element, cobalt, and at least one of magnesium and calcium, and that the circumference of the electrode is prevented from the current concentration to improve the discharge current withstand capability. Further, the inventors have found that the inhomogeneous portions within the resistor disappear at the same time to provide the voltage non-linear resistor with the greatly improved life performance.

According to the present invention, there is provided a voltage non-linear resistor which comprises a sintered body composed of a main component of zinc oxide, and additives of (i) a total of 0.08 to 5.0 atomic % of at least one kind of rare earth elements; (ii) 0.1 to 10.0 atomic % of cobalt; (iii) $5\times10^{-4}$ to $1\times10^{-1}$ atomic % of boron; and (iv) (a) a total of 0.01 to 5.0 atomic % of at least one of magnesium and calcium and/or (b) a total of $1\times10^{-4}$ to $5\times10^{-2}$ atomic % of at least one kind of aluminum, gallium and indium.

DETAILED DESCRIPTION OF THE INVENTION

In this case, "atomic %" means the percentage of atoms of added metal element against the total of atoms of respective metal elements in the composition which is mixed so as to produce the desired voltage non-linear resistor.

The voltage non-linear resistor composed of a sintered body of ZnO containing a rare earth element, cobalt, boron, at least one kind of aluminum, gallium and indium, and the voltage non-linear resistor composed of a sintered body of ZnO containing at least one of magnesium and calcium in addition to the additives, have good long duration discharge current withstand capability. On the contrary, the voltage non-linear resistor composed of a sintered body of ZnO containing a rare earth element, cobalt, boron, at least one of magnesium and calcium has good short duration discharge current withstand capability.

Preferred examples of the rare earth element include praseodymium, lanthanum, terbium, neodymium, samarium and dysprosium. Particularly preferred examples of the rare earth element include praseodymium, lanthanum and terbium.

The voltage non-linear resistor according to the present invention will be generally produced by sintering a mixture of ZnO and additional metals or compounds at a high temperature in an atmosphere containing oxygen.

Although the additives are usually added to the main component in the form of the metal oxides, compounds capable of changing to oxides in the sintering process, such as carbonates, hydroxides, fluorides, and their solutions, can be employed, or oxides can be made in the sintering process by using the additives in the form of elements.

According to a particularly preferable process, a voltage non-linear resistor of the present invention may be produced by sufficiently mixing powdery materials of additional metals or compounds with ZnO powder, prebaking the mixed powder in air at 500° to 1,000° C. for several hours, sufficiently pulverizing the prebaked body, molding the powdery material so as to obtain a molded body with a desired shape, and then baking the molded body in air at a temperature of the order of 1,100° to 1,400° C. for several hours. When the baking temperature is less than 1,100° C., the sintering is insufficient and the characteristics of the resistor are made unstable. On the contrary, when the baking temperature exceeds 1,400° C., it is difficult to obtain a homogeneously sintered body, so that it is difficult to provide practical useful goods because the voltage non-linearity is lowered and the reproducibility with respect to the control of the characteristics is scanty.

Specific embodiments will now be described for the purpose of illustrating the present invention. However, the scope of the present invention is not limited thereto.

EXAMPLE 1

Powdery materials of $Pr_6O_{11}$, $Co_3O_4$, MgO and $B_2O_3$, each amount corresponding to desired atomic % as listed in Table 1, were added to ZnO powder. After sufficiently mixing these powdery materials, the mixture was prebaked at 500° to 1,000° C. for several hours. Thereafter, the prebaked body was sufficiently pulverized and a binder was added to the powdery material. The mixed material was molded to make a disc with a diameter of 42 mm, and the disc was baked in air at 1,100° to 1,400° C. for 1 hour to obtain a sintered body. The sintered body thus provided was lapped to a thickness of 2 mm to obtain a sample. An electrode was formed on both surfaces of the sample to make a resistor, and the electrical characteristics were measured.

As electrical characteristics, a voltage $V_{1\,mA}$ across electrodes obtained when a current of 1 mA was applied to the resistor at 25° C., a non-linear exponent $\alpha$ at 1 mA to 10 mA and a short duration discharge current withstand capability were given. The short duration discharge current withstand capability was obtained by measuring the change of $V_{1\,mA}$ before and after an impulse current with 65 KA and $4\times10$ μsec was twice applied to the resistor. A life performance was obtained by applying DC current of 100 mA to the resistor for 5 minutes and measuring the change of $V_{1\,\mu A}$ (voltage in the case where a current of 1 μA was applied to the resistor) before and after the current application. The non-linear exponent $\alpha$ is obtained when the change of the resistor current I against the voltage is approximately given by the following formula $$I=(V/C)^{\alpha}$$

where C is a voltage of the resistor per the thickness when the current density is given by 1 mA/cm$^2$.

Table 1 also shows measured results of electrical characteristics which are obtained when the compositions of resistors are variously changed. The compositions in Table 1 are given by atomic % calculated from atoms of additional element against the total of atoms of respective metal elements in the mixed raw material.

TABLE 1

| Sample No. | Additives (atom %) Pr | Co | Mg | B | $V_1$ mA (V) | Non-Linear Exponent $\alpha$ | Discharge Current Withstand Capability $\Delta V_1$ mA (%) | Life Performance $\Delta V_1$ μA (%) |
|---|---|---|---|---|---|---|---|---|
| 1 | 0.1 | 5.0 | 0.10 | 0.0 | 311 | 37 | −58.6 | −28.3 |
| 2 | 0.01 | " | " | 0.010 | 251 | 19 | −11.1 | −38.5 |
| 3 | 0.08 | " | " | " | 290 | 34 | −1.1 | −4.1 |
| 4 | 0.10 | " | " | " | 299 | 38 | −1.5 | −2.3 |
| 5 | 0.50 | " | " | " | 330 | 45 | −0.3 | −2.6 |
| 6 | 1.0 | " | " | " | 380 | 32 | −1.4 | −3.8 |
| 7 | 5.0 | " | " | " | 407 | 33 | −24.3 | −7.8 |
| 8 | 7.0 | " | " | " | 425 | 30 | −69.7 | −31.4 |
| 9 | 0.10 | 0.05 | " | " | 127 | 7 | −88.2 | −11.9 |
| 10 | " | 0.10 | " | " | 231 | 25 | −14.6 | −7.3 |
| 11 | " | 0.50 | " | " | 251 | 27 | −11.8 | −6.4 |
| 12 | " | 1.0 | " | " | 243 | 41 | −3.2 | −2.1 |
| 13 | " | 10.0 | " | " | 269 | 21 | −10.8 | −16.8 |
| 14 | " | 15.0 | " | " | 323 | 18 | −65.3 | −46.2 |
| 15 | " | 5.0 | 0.010 | " | 290 | 37 | −3.3 | −3.1 |
| 16 | " | " | 0.50 | " | 294 | 39 | −0.8 | −5.2 |
| 17 | " | " | 1.0 | " | 307 | 29 | −2.1 | −4.8 |
| 18 | " | " | 5.0 | " | 349 | 27 | −20.3 | −8.6 |
| 19 | " | " | 7.0 | " | 354 | 18 | −72.4 | −15.9 |
| 20 | " | " | 0.10 | 0.0001 | 311 | 39 | −61.7 | −23.1 |
| 21 | " | " | " | 0.0005 | 307 | 37 | −52.5 | −6.8 |
| 22 | " | " | " | 0.0010 | 308 | 41 | −18.1 | −5.1 |
| 23 | " | " | " | 0.0050 | 304 | 43 | −3.1 | −3.2 |
| 24 | " | " | " | 0.050 | 272 | 36 | −3.4 | −3.8 |
| 25 | " | " | " | 0.10 | 235 | 30 | −4.2 | −8.3 |
| 26 | " | " | " | 0.50 | 132 | 12 | −5.4 | −18.6 |

Sample No. 1 corresponds to a conventional resistor which is produced by adding only Pr, Co and Mg to ZnO. The short duration discharge current withstand capability is −58.6%, the life performance is −28.3%, and the non-linear exponent is 37, respectively. The samples, which have good short duration discharge current withstand capability, that is, the values of short duration discharge current withstand capability being closer to 0% rather than −58.6% and improved life performance, that is, the values of life performance being closer to 0% rather than −28.3% according to the object of the present invention, are given by Nos. 3 to 7, Nos. 10 to 13, Nos. 15 to 18 and Nos. 21 to 26, respectively, as shown in Table 1. However, the sample No. 26 is not practically used because the non-linear exponent $\alpha$ is low. Accordingly, it is necessary that 0.08 to 5.0 atomic % of Pr, 0.1 to 10.0 atomic % of Co, 0.01 to 5.0 atomic % of Mg, and 0.0005 to 0.1 atomic % of B are added to the ZnO.

As is evident from Table 1, the short duration discharge current withstand capability and the life performance are remarkably improved by adding B to the additives of Pr, Co and Mg. These effects are first achieved due to the coexistence of Pr, Co, Mg and B together with ZnO. If these additives are independently added to ZnO, the voltage non-linearity is greatly deteriorated and only the approximate ohmic characteristic is obtained, so that the resistors cannot be practically used.

In Table 1, only Pr was illustrated as the rare earth element, but the short duration discharge current withstand capability and the life performance were remarkably improved without lowering good non-linearity in the same grade as in the case where only Pr was added as rare earth element by adding B to the additives even if another rare earth element except Pr or more than two kinds of rare earth elements were used. These results are shown in Table 2.

TABLE 2

| Sample No. | Additives (atom %) Rare Earth Component Element | Atom % | Co | Mg | B | $V_1$ mA (V) | Non-Linear Exponent α | Discharge Current Withstand Capability $\Delta V_1$ mA (%) | Life Performance $\Delta V_1$ μA (%) |
|---|---|---|---|---|---|---|---|---|---|
| 27 | Tb | 1.0 | 1.0 | 0.10 | 0.001 | 335 | 31 | −7.6 | −9.5 |
| 28 | | " | " | " | 0.010 | 321 | 26 | −3.2 | −5.4 |
| 29 | | " | " | " | 0.10 | 294 | 23 | −3.1 | −6.3 |
| 30 | La | 1.0 | 2.0 | " | 0.001 | 223 | 28 | −5.8 | −8.8 |
| 31 | | " | " | " | 0.010 | 215 | 29 | −1.2 | −3.6 |
| 32 | | " | " | " | 0.10 | 200 | 24 | −1.8 | −3.2 |
| 33 | Nd | 1.0 | 5.0 | " | 0.001 | 235 | 33 | −8.6 | −7.2 |
| 34 | | " | " | " | 0.01 | 222 | 25 | −4.9 | −6.8 |
| 35 | | " | " | " | 0.10 | 210 | 24 | −4.1 | −5.7 |
| 36 | Sm | 1.0 | 5.0 | " | 0.001 | 255 | 25 | −8.3 | −9.2 |
| 37 | | " | " | " | 0.010 | 237 | 26 | −5.4 | −6.1 |
| 38 | | " | " | " | 0.10 | 224 | 24 | −6.1 | −4.3 |
| 39 | Dy | 1.0 | 1.0 | " | 0.001 | 328 | 35 | −7.6 | −6.9 |
| 40 | | " | " | " | 0.010 | 306 | 29 | −2.2 | −3.1 |
| 41 | | " | " | " | 0.10 | 282 | 24 | −3.1 | −2.9 |
| 42 | Pr + La | 0.5 + 0.5 | 1.0 | " | 0.001 | 301 | 33 | −9.1 | −5.3 |
| 43 | | " | " | " | 0.010 | 289 | 32 | −1.7 | −2.1 |
| 44 | | " | " | " | 0.10 | 273 | 29 | −2.3 | −3.9 |

Tables 3 and 4 show the characteristics of resistors which are produced by using Ca instead of Mg. As is evident from these Tables, it is necessary that 0.08 to 5.0 atomic % of a rare earth element, 0.1 to 10.0 atomic % of Co, 0.01 to 5.0 atomic % of Ca and $5\times10^{-4}$ to $1\times10^{-1}$ atomic % of B are added to ZnO.

TABLE 3

| Sample No. | Additives (atom %) Pr | Co | Ca | B | $V_1$ mA (V) | Non-Linear Exponent α | Discharge Current Withstand Capability $\Delta V_1$ mA (%) | Life Performance $\Delta V_1$ μA (%) |
|---|---|---|---|---|---|---|---|---|
| 45 | 0.10 | 5.0 | 0.10 | 0.0 | 323 | 41 | −83.1 | −21.2 |
| 46 | 0.01 | " | " | 0.010 | 270 | 25 | −12.3 | −27.4 |
| 47 | 0.08 | " | " | " | 285 | 38 | −2.1 | −5.6 |
| 48 | 0.10 | " | " | " | 295 | 43 | −2.3 | −4.3 |
| 49 | 0.50 | " | " | " | 338 | 46 | −1.4 | −4.1 |
| 50 | 1.0 | " | " | " | 394 | 35 | −1.8 | −4.8 |
| 51 | 5.0 | " | " | " | 411 | 38 | −18.3 | −8.2 |
| 52 | 7.0 | " | " | " | 436 | 35 | −73.6 | −30.3 |
| 53 | 0.10 | 0.05 | " | " | 118 | 9 | −79.1 | −9.8 |
| 54 | " | 0.10 | " | " | 229 | 28 | −21.4 | −6.4 |
| 55 | " | 0.50 | " | " | 263 | 30 | −8.3 | −5.1 |
| 56 | " | 1.0 | " | " | 252 | 45 | −2.4 | −1.2 |
| 57 | " | 10.0 | " | " | 270 | 26 | −8.3 | −19.4 |
| 58 | " | 15.0 | " | " | 321 | 23 | −72.2 | −26.5 |
| 59 | " | 5.0 | 0.010 | " | 293 | 44 | −1.4 | −2.8 |
| 60 | " | " | 0.50 | " | 298 | 48 | −0.5 | −6.3 |
| 61 | " | " | 1.0 | " | 317 | 33 | −1.3 | −4.2 |
| 62 | " | " | 5.0 | " | 346 | 31 | −15.9 | −11.3 |
| 63 | " | " | 7.0 | " | 357 | 19 | −84.2 | −18.7 |
| 64 | " | " | 0.10 | 0.0001 | 331 | 46 | −75.3 | −17.4 |
| 65 | " | " | " | 0.0005 | 315 | 39 | −48.1 | −4.1 |
| 66 | " | " | " | 0.0010 | 321 | 42 | −23.6 | −3.9 |
| 67 | " | " | " | 0.0050 | 313 | 47 | −2.8 | −2.6 |
| 68 | " | " | " | 0.050 | 279 | 39 | −3.1 | −3.3 |
| 69 | " | " | " | 0.10 | 241 | 35 | −4.0 | −7.6 |
| 70 | " | " | " | 0.50 | 136 | 8 | −4.8 | −17.2 |

TABLE 4

| Sample No. | Additives (atom %) Rare Earth Component Element | Atom % | Co | Ca | B | $V_1$ mA (V) | Non-Linear Exponent α | Discharge Current Withstand Capability $\Delta V_1$ mA (%) | Life Performance $\Delta V_1$ μA (%) |
|---|---|---|---|---|---|---|---|---|---|
| 71 | Tb | 1.0 | 1.0 | 0.10 | 0.001 | 343 | 36 | −9.4 | −8.3 |
| 72 | | " | " | " | 0.010 | 336 | 29 | −4.1 | −4.2 |
| 73 | | " | " | " | 0.10 | 303 | 28 | −4.3 | −3.3 |
| 74 | La | 1.0 | 2.0 | " | 0.001 | 227 | 34 | −6.7 | −7.1 |
| 75 | | " | " | " | 0.010 | 221 | 32 | −2.3 | −2.3 |
| 76 | | " | " | " | 0.10 | 205 | 26 | −3.1 | −1.8 |
| 77 | Nd | 1.0 | 5.0 | " | 0.001 | 238 | 38 | −9.6 | −4.6 |
| 78 | | " | " | " | 0.010 | 227 | 27 | −5.7 | −3.9 |
| 79 | | " | " | " | 0.10 | 224 | 28 | −6.3 | −4.1 |
| 80 | Sm | 1.0 | 5.0 | " | 0.001 | 261 | 30 | −9.1 | −8.1 |
| 81 | | " | " | " | 0.010 | 243 | 27 | −7.2 | −5.4 |
| 82 | | " | " | " | 0.10 | 229 | 29 | −8.1 | −3.1 |
| 83 | Dy | 1.0 | 1.0 | " | 0.001 | 331 | 38 | −9.6 | −3.5 |
| 84 | | " | " | " | 0.010 | 311 | 30 | −3.3 | −1.3 |
| 85 | | " | " | " | 0.10 | 290 | 29 | −4.2 | −1.2 |
| 86 | Pr + La | 0.5 + 0.5 | 1.0 | " | 0.001 | 311 | 34 | −10.0 | −3.3 |
| 87 | | " | " | " | 0.010 | 293 | 37 | −3.1 | −1.4 |
| 88 | | " | " | " | 0.10 | 284 | 33 | −4.3 | −2.7 |

Further, Table 5 shows the characteristics of resistors which contain Mg and Ca so that they can coexist. It is apparent from Table 5 that the same effects as those of the independent case can be obtained if Mg and Ca coexist.

TABLE 5

| Sample No. | Additives (atom %) Pr | Co | Mg | Ca | B | $V_1$ mA (V) | Non-Linear Exponent α | Discharge Current Withstand Capability $\Delta V_1$ mA (%) | Life Performance $\Delta V_1$ μA (%) |
|---|---|---|---|---|---|---|---|---|---|
| 89 | 0.10 | 5.0 | 0.10 | 0.10 | 0.001 | 325 | 40 | −20.1 | −4.2 |
| 90 | " | " | " | " | 0.010 | 299 | 44 | −1.4 | −3.1 |
| 91 | " | " | " | " | 0.10 | 257 | 36 | −3.8 | −8.8 |

It is apparent from Tables 3, 4 and 5 that the presence of at least one of Mg and Ca affects uniformity of characteristics of resistors. Further, the uniformity of grains formed was observed.

EXAMPLE 2

Powdery materials of $Pr_6O_{11}$, $Co_3O_4$, $B_2O_3$ and $Al_2O_3$, each amount corresponding to desired atomic % as listed in Table 6, were added to ZnO powder. After sufficiently mixing these powdery materials, the mixture was prebaked at 500° to 1,000° C. for several hours. Thereafter, the prebaked body was sufficiently pulverized and a binder was added to the powdery material. The mixed material was molded to make a disc with a diameter of 17 mm, and the disc was baked in air at 1,100° to 1,400° C. for 1 hour to obtain a sintered body. The sintered body thus obtained was lapped to a thickness of 2 mm to provide a sample. An electrode was formed on both surfaces of the sample to make a resistor, and the electrical characteristics were measured.

As electrical characteristics, a voltage $V_{1\,mA}$ across electrodes obtained when a current of 1 mA was applied to the resistor at 25° C., a non-linear exponent α at 1 mA to 10 mA, and a long duration discharge current withstand capability were given. The long duration discharge current withstand capability was provided by obtaining an average value of change in $V_{1\,mA}$ before and after a rectangular pulse current with 100 A and 2 msec was applied 20 times. The life performance was obtained by applying DC current of 20 mA to the resistor for 5 minutes and measuring the change of $V_{1\,\mu A}$ (voltage in the case where a current of 1 μA was applied to the resistor) before and after the current application. The non-linear exponent α was obtained by the same method as that of Example 1.

Measured results of electrical characteristics, which are obtained when the compositions of resistors are variously changed, are also listed in Table 6. The compositions listed in Table 6 are given by atomic % calculated from atoms of additional element against the total of atoms of respective metal elements in the mixed raw material.

TABLE 6

| Sample No. | Additives (atom %) Pr | Co | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|
| 1 | 0.1 | 5.0 | 0.0 | 0.0 | 292 | 35 | −100.0 | −18.1 |
| 2 | 0.01 | " | 0.01 | 0.005 | 159 | 20 | −43.1 | −58.1 |
| 3 | 0.08 | " | " | " | 183 | 38 | −8.7 | −8.3 |
| 4 | 0.10 | " | " | " | 190 | 45 | −2.6 | −5.3 |

TABLE 6-continued

| Sample No. | Additives (atom %) Pr | Co | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|
| 5 | 0.50 | " | " | " | 203 | 41 | −2.3 | −2.6 |
| 6 | 1.0 | " | " | " | 241 | 42 | −3.4 | −3.1 |
| 7 | 5.0 | " | " | " | 260 | 33 | −22.3 | −9.6 |
| 8 | 7.0 | " | " | " | 266 | 30 | −89.6 | −15.3 |
| 9 | 0.1 | 0.05 | " | " | 83 | 11 | −78.1 | −43.5 |
| 10 | " | 0.10 | " | " | 147 | 28 | −32.3 | −12.3 |
| 11 | " | 0.50 | " | " | 165 | 28 | −4.6 | −4.1 |
| 12 | " | 1.0 | " | " | 158 | 38 | −3.8 | −5.9 |
| 13 | " | 10.0 | " | " | 171 | 20 | −21.6 | −13.2 |
| 14 | " | 15.0 | " | " | 203 | 15 | −91.4 | −71.3 |
| 15 | " | 5.0 | 0.0001 | " | 190 | 33 | −64.6 | −18.9 |
| 16 | " | " | 0.0005 | " | 198 | 38 | −32.1 | −7.5 |
| 17 | " | " | 0.0010 | " | 195 | 43 | −12.3 | −3.2 |
| 18 | " | " | 0.0050 | " | 193 | 42 | −3.9 | −2.9 |
| 19 | " | " | 0.050 | " | 170 | 36 | −2.8 | −4.7 |
| 20 | " | " | 0.10 | " | 143 | 20 | −3.3 | −8.6 |
| 21 | " | " | 0.50 | " | 91 | 9 | −5.2 | −12.3 |
| 22 | " | " | 0.01 | 0.00001 | 258 | 33 | −65.1 | −9.4 |
| 23 | " | " | " | 0.00010 | 241 | 37 | −48.3 | −5.7 |
| 24 | " | " | " | 0.0010 | 203 | 41 | −3.7 | −1.8 |
| 25 | " | " | " | 0.010 | 208 | 36 | −2.1 | −3.7 |
| 26 | " | " | " | 0.050 | 173 | 31 | −4.8 | −7.6 |
| 27 | " | " | " | 0.10 | 41 | 8 | −26.9 | −25.3 |

The sample No. 1 corresponds to a conventional resistor which is produced by adding only Pr and Co to ZnO. The long duration discharge current withstand capability is −100.0%, the life performance is −18.1%, and the non-linear exponent is 35, respectively. The samples, which have good long duration discharge current withstand capability, that is, the values of long duration discharge current withstand capability being closer to 0% rather than −100.0% and improved life performance, that is, the values of life performance being closer to 0% rather than −18.1% according to the object of the present invention, are given by Nos. 3 to 7, Nos. 10 to 13, Nos. 16 to 21, and Nos. 23 to 26, respectively, as shown in Table 6. However, the sample No. 21 is not practically used because the non-linear exponent α is low. Accordingly, it is necessary that 0.08 to 5.0 atomic % of Pr, 0.1 to 10.0 atomic % of Co, 0.0005 to 0.1 atomic % of B and $1\times10^{-4}$ to $5\times10^{-2}$ atomic % of Al are added to ZnO.

As is evident from Table 6, the long duration discharge current withstand capability and the life performance are remarkably improved by adding B and Al to the additives of Pr and Co. These effects are first achieved by the coexistence of Pr, Co, B and Al together with ZnO. If these additives are independently added to ZnO, the voltage non-linearity is greatly deteriorated and only the approximate ohmic characteristic is obtained, so that the resistors cannot be practically employed.

In Table 6, only Pr was illustrated as the rare earth element, but the long duration discharge current withstand capability and the life performance were remarkably improved without lowering good non-linearity in the same grade as in the case where only Pr was added as rare earth element by adding B and Al to the additives even if another rare earth element except Pr or more than two kinds of rare earth elements were used. These results are shown in Table 7. Further, the same effects as those of Tables 6 and 7 were obtained even if gallium or indium was used instead of Al.

TABLE 7

| Sample No. | Additives (atom %) Rare Earth Component Element | Atom % | Co | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|---|
| 28 | Tb | 1.0 | 1.0 | 0.01 | 0.005 | 233 | 27 | −6.3 | −12.1 |
| 29 | | " | " | " | 0.010 | 247 | 25 | −2.4 | −8.3 |
| 30 | | " | " | " | 0.050 | 183 | 21 | −3.4 | −6.3 |
| 31 | La | 1.0 | 2.0 | " | 0.005 | 174 | 23 | −6.8 | −8.4 |
| 32 | | " | " | " | 0.010 | 181 | 28 | −3.1 | −5.6 |
| 33 | | " | " | " | 0.050 | 121 | 20 | −2.6 | −7.4 |
| 34 | Nd | 1.0 | 5.0 | " | 0.005 | 164 | 28 | −4.8 | −9.4 |
| 35 | | " | " | " | 0.010 | 151 | 27 | −3.2 | −8.6 |
| 36 | | " | " | " | 0.050 | 108 | 22 | −8.1 | −8.3 |
| 37 | Sm | 1.0 | 5.0 | " | 0.005 | 208 | 26 | −2.6 | −6.5 |
| 38 | | " | " | " | 0.010 | 210 | 26 | −2.7 | −7.7 |
| 39 | | " | " | " | 0.050 | 186 | 23 | −5.9 | −9.6 |
| 40 | Dy | 1.0 | 1.0 | " | 0.005 | 254 | 29 | −2.8 | −7.8 |
| 41 | | " | " | " | 0.010 | 263 | 30 | −3.8 | −6.6 |
| 42 | | " | " | " | 0.050 | 198 | 25 | −4.7 | −5.8 |
| 43 | Pr + La | 0.5 + 0.5 | 1.0 | " | 0.005 | 265 | 33 | −2.6 | −2.1 |
| 44 | | " | " | " | 0.010 | 291 | 30 | −1.8 | −3.8 |

TABLE 7-continued

| Sample No. | Additives (atom %) Rare Earth Component Element | Atom % | Co | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|---|
| 45 | | " | " | " | 0.050 | 184 | 22 | −2.6 | −2.6 |

EXAMPLE 3

Powdery materials of $Pr_6O_{11}$, $Co_3O_4$, MgO, $B_2O_3$ and $Al_2O_3$, each amount corresponding to desired atomic % as listed in Table 8, were added to ZnO powder. After sufficiently mixing these powdery materials, the mixture was prebaked at 500° to 1,000° C. for several hours. Thereafter, the prebaked body was sufficiently pulverized and a binder was added to the powdery material. The mixed material was molded to make a disc with a diameter of 17 mm, and the disc was baked in air at 1,100° to 1,400° C. for 1 hour to obtain a sintered body. The sintered body thus obtained was lapped to a thickness of 2 mm to provide a sample. An electrode was formed on both surfaces of the sample to make a resistor, and the electrical characteristics were measured.

As electrical characteristics, a voltage $V_{1\,mA}$ across electrodes obtained when a current of 1 mA was applied to the resistor at 25° C., a non-linear exponent α at 1 mA to 10 mA, and a long duration discharge current withstand capability were given. The long duration discharge current withstand capability was provided by obtaining an average value of change in $V_{1\,mA}$ before and after a rectangular pulse current with 100 A and 2 msec was applied 20 times. The life performance was obtained by applying DC current of 20 mA to the resistor for 5 minutes and measuring the change of $V_{1\,\mu A}$ (voltage in the case where a current of 1 μA was applied to the resistor) before and after the current application. The non-linear exponent α was obtained by the same method as that of Example 1.

Measured results of electrical characteristics, which are obtained when the compositions of resistors are variously changed, are also listed in Table 8. The compositions listed in Table 8 are given by atomic % calculated from atoms of additional element against the total of atoms of respective metal elements in the mixed raw material.

TABLE 8

| Sample No. | Additives (atom %) Pr | Co | Mg | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|---|
| 1 | 0.10 | 5.0 | 0.10 | 0.0 | 0.0 | 311 | 37 | −100.0 | −19.6 |
| 2 | 0.01 | " | " | 0.010 | 0.0050 | 165 | 23 | −72.1 | −43.6 |
| 3 | 0.08 | " | " | " | " | 183 | 39 | −1.5 | −3.2 |
| 4 | 0.10 | " | " | " | " | 214 | 43 | −1.3 | −2.8 |
| 5 | 0.50 | " | " | " | " | 224 | 45 | −1.2 | −2.1 |
| 6 | 1.0 | " | " | " | " | 258 | 43 | −1.2 | −3.4 |
| 7 | 5.0 | " | " | " | " | 240 | 37 | −21.1 | −8.4 |
| 8 | 7.0 | " | " | " | " | 231 | 36 | −75.4 | −23.9 |
| 9 | 0.10 | 0.05 | " | " | " | 87 | 8 | −89.4 | −23.2 |
| 10 | " | 0.10 | " | " | " | 163 | 31 | −32.1 | −14.8 |
| 11 | " | 0.50 | " | " | " | 169 | 30 | −25.2 | −3.4 |
| 12 | " | 1.0 | " | " | " | 172 | 39 | −8.4 | −4.2 |
| 13 | " | 10.0 | " | " | " | 184 | 28 | −36.3 | −15.8 |
| 14 | " | 15.0 | " | " | " | 221 | 16 | −89.5 | −80.2 |
| 15 | " | 5.0 | 0.010 | " | " | 203 | 35 | −8.2 | −8.7 |
| 16 | " | " | 0.50 | " | " | 198 | 41 | −9.2 | −7.3 |
| 17 | " | " | 1.0 | " | " | 203 | 39 | −18.9 | −9.1 |
| 18 | " | " | 5.0 | " | " | 235 | 33 | −25.6 | −17.4 |
| 19 | " | " | 7.0 | " | " | 230 | 16 | −33.1 | −25.4 |
| 20 | " | " | 0.10 | 0.0001 | " | 214 | 35 | −78.4 | −19.0 |
| 21 | " | " | " | 0.0005 | " | 203 | 37 | −28.3 | −12.3 |
| 22 | " | " | " | 0.0010 | " | 205 | 45 | −10.8 | −8.8 |
| 23 | " | " | " | 0.0050 | " | 201 | 43 | −3.4 | −5.6 |
| 24 | " | " | " | 0.050 | " | 188 | 39 | −7.2 | −4.3 |
| 25 | " | " | " | 0.10 | " | 159 | 19 | −6.9 | −7.8 |
| 26 | " | " | " | 0.50 | " | 91 | 8 | −8.9 | −10.6 |
| 27 | " | " | " | 0.010 | 0.00001 | 283 | 37 | −85.1 | −12.3 |
| 28 | " | " | " | 0.010 | 0.00010 | 238 | 41 | −56.2 | −4.7 |
| 29 | " | " | " | " | 0.0010 | 225 | 38 | −4.3 | −4.2 |
| 30 | " | " | " | " | 0.010 | 231 | 34 | −2.8 | −3.8 |
| 31 | " | " | " | " | 0.050 | 192 | 31 | −9.3 | −3.6 |
| 32 | " | " | " | " | 0.10 | 81 | 7 | −15.4 | −13.6 |

The sample No. 1 corresponds to a conventional resistor which is produced by adding only Pr, Co and Mg to ZnO. The long duration discharge current withstand capability is −100.0%, the life performance is −19.6%, and the non-linear exponent is 37, respectively. The samples, which have good long duration discharge current withstand capability, that is, the values of long duration discharge current withstand capability being closer to 0% rather than −100.0% and the improved life performance, that is, the values of life performance being closer to 0% rather than −19.6% according to the object of the present invention, are given by Nos. 3 to 7, Nos. 10 to 13, Nos. 15 to 18, Nos. 21 to 26, and Nos. 28 to 31, respectively, as shown in Table 8. However, the sample No. 26 is not practically used because the non-linear exponent $\alpha$ is low. Accordingly, it is necessary that 0.08 to 5.0 atomic % of Pr, 0.1 to 10.0 atomic % of Co, 0.01 to 5.0 atomic % of Mg, and 0.0005 to 0.1 atomic % of B are added to ZnO.

As is evident from Table 8, the long duration discharge current withstand capability and the life performance are remarkably improved by adding B and Al to the additives of Pr, Co and Mg. These effects are first achieved by the coexistence of Pr, Co, Mg, B and Al together with ZnO. If these additives are independently added to ZnO, the voltage non-linearity is greatly deteriorated and only the approximate ohmic characteristic is obtained, so that the resistors cannot be practically employed.

In Table 8, only Pr was illustrated as the rare earth element, but the long duration discharge current withstand capability and the life performance were remarkably improved without lowering good non-linearity in the same grade as in the case where only Pr was added as rare earth element by adding B and Al to the additives even if another rare earth element except Pr or more than two kinds of rare earth elements were used. These results are shown in Table 9.

TABLE 9

| Sample No. | Additives (atom %) Rare Earth Component Element | Atom % | Co | Mg | B | Al | $V_1$ mA (V) | Non-Linear Exponent $\alpha$ | Long Duration Discharge Current Withstand Capability $\Delta V_1$ mA (%) | Life Performance $\Delta V_1$ μA (%) |
|---|---|---|---|---|---|---|---|---|---|---|
| 33 | Tb | 1.0 | 1.0 | 0.10 | 0.010 | 0.0050 | 228 | 29 | −5.8 | −10.3 |
| 34 | " | " | " | " | " | 0.010 | 241 | 27 | −3.2 | −6.4 |
| 35 | " | " | " | " | " | 0.050 | 172 | 23 | −3.3 | −5.8 |
| 36 | La | 1.0 | 2.0 | " | " | 0.0050 | 158 | 20 | −7.6 | −7.6 |
| 37 | " | " | " | " | " | 0.010 | 179 | 27 | −3.3 | −8.1 |
| 38 | " | " | " | " | " | 0.050 | 88 | 22 | −1.9 | −4.2 |
| 39 | Nd | 1.0 | 5.0 | " | " | 0.0050 | 151 | 24 | −5.7 | −9.6 |
| 40 | " | " | " | " | " | 0.010 | 162 | 25 | −3.8 | −8.2 |
| 41 | " | " | " | " | " | 0.050 | 93 | 18 | −7.7 | −7.6 |
| 42 | Sm | 1.0 | 5.0 | " | " | 0.0050 | 171 | 27 | −4.8 | −8.4 |
| 43 | " | " | " | " | " | 0.010 | 198 | 28 | −5.1 | −7.7 |
| 44 | " | " | " | " | " | 0.050 | 112 | 21 | −6.4 | −4.3 |
| 45 | Dy | 1.0 | 1.0 | " | " | 0.0050 | 215 | 28 | −3.4 | −8.1 |
| 46 | " | " | " | " | " | 0.010 | 234 | 29 | −3.9 | −3.6 |
| 47 | " | " | " | " | " | 0.050 | 183 | 22 | −8.3 | −5.7 |
| 48 | Pr + La | 0.5 + 0.5 | 1.0 | " | " | 0.0050 | 204 | 35 | −3.7 | −3.2 |
| 49 | " | " | " | " | " | 0.010 | 226 | 33 | −2.1 | −4.1 |
| 50 | " | " | " | " | " | 0.050 | 173 | 24 | −3.4 | −3.3 |

Tables 10 and 11 show characteristics of resistors produced by using Ca instead of Mg. As is evident from Tables 10 and 11, it is necessary that 0.08 to 5.0 atomic % of rare earth element, 0.1 to 10.0 atomic % of Co, 0.01 to 5.0 atomic % of Ca, $5\times10^{-4}$ to $1\times10^{-1}$ atomic % of B and $1\times10^{-4}$ to $5\times10^{-2}$ atomic % of Al are added to ZnO.

TABLE 10

| Sample No. | Additives (atom %) Pr | Co | Ca | B | Al | $V_1$ mA (V) | Non-Linear Exponent $\alpha$ | Long Duration Discharge Current Withstand Capability $\Delta V_1$ mA (%) | Life Performance $\Delta V_1$ μA (%) |
|---|---|---|---|---|---|---|---|---|---|
| 51 | 0.10 | 5.0 | 0.10 | 0.0 | 0.0 | 323 | 41 | −100.0 | −18.4 |
| 52 | 0.01 | " | " | 0.01 | 0.0050 | 182 | 27 | −80.3 | −52.1 |
| 53 | 0.08 | " | " | " | " | 193 | 39 | −2.1 | −4.1 |
| 54 | 0.10 | " | " | " | " | 198 | 45 | −1.6 | −3.7 |
| 55 | 0.50 | " | " | " | " | 224 | 46 | −1.1 | −2.6 |
| 56 | 1.0 | " | " | " | " | 267 | 38 | −1.5 | −3.8 |
| 57 | 5.0 | " | " | " | " | 271 | 41 | −16.3 | −8.7 |
| 58 | 7.0 | " | " | " | " | 294 | 37 | −76.4 | −25.7 |
| 59 | 0.10 | 0.05 | " | " | " | 85 | 7 | −83.6 | −27.2 |
| 60 | " | 0.10 | " | " | " | 167 | 31 | −31.9 | −11.2 |
| 61 | " | 0.50 | " | " | " | 192 | 35 | −21.3 | −3.2 |
| 62 | " | 1.0 | " | " | " | 180 | 45 | −6.7 | −2.8 |
| 63 | " | 10.0 | " | " | " | 197 | 27 | −40.6 | −12.7 |
| 64 | " | 15.0 | " | " | " | 233 | 22 | −87.3 | −75.2 |
| 65 | " | 5.0 | 0.010 | " | " | 215 | 47 | −12.1 | −6.4 |
| 66 | " | " | 0.50 | " | " | 213 | 48 | −9.8 | −3.6 |
| 67 | " | " | 1.0 | " | " | 231 | 37 | −15.1 | −8.6 |
| 68 | " | " | 5.0 | " | " | 247 | 35 | −21.3 | −16.1 |
| 69 | " | " | 7.0 | " | " | 258 | 18 | −48.2 | −31.2 |
| 70 | " | " | 0.10 | 0.0001 | " | 235 | 45 | −83.2 | −20.1 |
| 71 | " | " | " | 0.0005 | " | 227 | 39 | −33.2 | −10.8 |
| 72 | " | " | " | 0.0010 | " | 230 | 43 | −9.6 | −6.8 |
| 73 | " | " | " | 0.0050 | " | 225 | 49 | −2.8 | −5.7 |
| 74 | " | " | " | 0.050 | " | 205 | 40 | −4.4 | −3.9 |

TABLE 10-continued

| Sample No. | Additives (atom %) Pr | Co | Ca | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|---|
| 75 | " | " | " | 0.10 | " | 174 | 36 | −6.5 | −8.1 |
| 76 | " | " | " | 0.50 | " | 101 | 9 | −7.8 | −12.2 |
| 77 | " | " | " | 0.010 | 0.00001 | 288 | 36 | −72.1 | −11.8 |
| 78 | " | " | " | 0.010 | 0.00010 | 265 | 38 | −49.6 | −5.2 |
| 79 | " | " | " | " | 0.0010 | 236 | 44 | −2.7 | −3.9 |
| 80 | " | " | " | " | 0.010 | 207 | 39 | −1.8 | −4.3 |
| 81 | " | " | " | " | 0.050 | 184 | 31 | −7.6 | −5.2 |
| 82 | " | " | " | " | 0.10 | 98 | 7 | −13.7 | −16.8 |

TABLE 11

| Sample No. | Additives (atom %) Rare Earth Component Element | Atom % | Co | Ca | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|---|---|
| 83 | Tb | 1.0 | 1.0 | 0.10 | 0.010 | 0.0050 | 231 | 38 | −4.2 | −11.2 |
| 84 | " | " | " | " | " | 0.010 | 242 | 31 | −3.8 | −5.8 |
| 85 | " | " | " | " | " | 0.050 | 208 | 22 | −5.6 | −6.4 |
| 86 | La | 1.0 | 2.0 | " | " | 0.0050 | 165 | 33 | −4.9 | −3.9 |
| 87 | " | " | " | " | " | 0.010 | 160 | 37 | −3.9 | −8.8 |
| 88 | " | " | " | " | " | 0.050 | 139 | 21 | −2.3 | −4.6 |
| 89 | Nd | 1.0 | 5.0 | " | " | 0.0050 | 170 | 39 | −7.2 | −5.2 |
| 90 | " | " | " | " | " | 0.010 | 161 | 26 | −3.6 | −6.3 |
| 91 | " | " | " | " | " | 0.050 | 165 | 23 | −8.2 | −4.8 |
| 92 | Sm | 1.0 | 5.0 | " | " | 0.0050 | 181 | 34 | −5.4 | −7.2 |
| 93 | " | " | " | " | " | 0.010 | 177 | 30 | −3.6 | −5.4 |
| 94 | " | " | " | " | " | 0.050 | 163 | 22 | −7.2 | −6.3 |
| 95 | Dy | 1.0 | 1.0 | " | " | 0.0050 | 238 | 33 | −8.2 | −6.9 |
| 96 | " | " | " | " | " | 0.010 | 224 | 35 | −3.6 | −5.1 |
| 97 | " | " | " | " | " | 0.050 | 203 | 23 | −9.2 | −4.3 |
| 98 | Pr + La | 0.5 + 0.5 | 1.0 | " | " | 0.0050 | 224 | 37 | −2.8 | −3.6 |
| 99 | " | " | " | " | " | 0.010 | 214 | 35 | −3.4 | −2.8 |
| 100 | " | " | " | " | " | 0.050 | 208 | 26 | −6.7 | −5.4 |

Further, Table 12 shows the characteristics of resistors which contain Mg and Ca so that they can coexist. It is apparent from Table 12 that the same effects as the independent case can be obtained even if Mg and Ca coexist. Further, the same effects as those of Tables 8 to 12 were obtained even if gallium or indium was used instead of Al.

TABLE 12

| Sample No. | Additives (atom %) Pr | Co | Mg | Ca | B | Al | $V_1$ mA (V) | Non-Linear Exponent α | Long Duration Discharge Current Withstand Capability $\Delta V_1$ mA (%) | Life Performance $\Delta V_1$ μA (%) |
|---|---|---|---|---|---|---|---|---|---|---|
| 101 | 0.10 | 5.0 | 0.10 | 0.10 | 0.0010 | 0.0050 | 218 | 48 | −12.9 | −3.8 |
| 102 | " | " | " | " | 0.010 | " | 203 | 46 | −2.1 | −3.6 |
| 103 | " | " | " | " | 0.10 | " | 172 | 33 | −2.7 | −4.2 |
| 104 | " | " | " | " | 0.010 | 0.0050 | 203 | 47 | −1.3 | −2.9 |
| 105 | " | " | " | " | " | 0.010 | 224 | 41 | −2.6 | −3.4 |
| 106 | " | " | " | " | " | 0.050 | 188 | 33 | −8.6 | −4.8 |

According to voltage non-linear resistors of the present invention as described above, the discharge current withstand capability and the life performance will be greatly improved, while keeping good voltage non-linearity. Therefore, the voltage non-linear resistors can be effectively used as varistors.

While the invention has been described in detail and with reference to specific embodiments thereof, it will be apparent to one skilled in the art that various changes and modifications can be made therein without departing from the spirit and scope thereof.

What is claimed is:

1. A voltage non-linear resistor comprising a sintered body composed of a main component of zinc oxide, and additives of (i) a total of 0.08 to 5.0 atomic % of at least one rare earth element; (ii) 0.1 to 10.0 atomic % of cobalt; (iii) $5\times10^{-4}$ to $1\times10^{-1}$ atomic % of boron; and (iv) a total of $1\times10^{-4}$ to $5\times10^{-2}$ atomic % of at least one component selected from the group of aluminum, gallium, and indium.

2. A voltage non-linear resistor comprising a sintered body composed of a main component of zinc oxide, and additives of (i) a total of 0.08 to 5.0 atomic % of at least one rare earth element; (ii) 0.1 to 10.0 atomic % of cobalt; (iii) $5\times10^{-4}$ to $1\times10^{-1}$ atomic % of boron; (iv) a total of $1\times10^{-4}$ to $5\times10^{-2}$ atomic % of at least one component selected from the group of aluminum, gallium and indium, and (v) a total of 0.01 to 5.0 atomic % of at least one component selected from the group of magnesium and calcium.

* * * * *